United States Patent [19]

McAlister

[11] 4,329,391

[45] May 11, 1982

[54] SYNTHETIC FIBER SURFACE-MODIFICATION PROCESS

[75] Inventor: Eugene S. McAlister, St. Paul, Minn.

[73] Assignee: Minnesota Mining and Manufacturing Company, St. Paul, Minn.

[21] Appl. No.: 191,289

[22] Filed: Sep. 26, 1980

[51] Int. Cl.[3] ..... B32B 7/00; B32B 27/00; B32B 27/34; B05D 3/10

[52] U.S. Cl. ..... 428/265; 427/336; 427/393.4; 428/267; 428/290; 528/293; 528/295; 524/166

[58] Field of Search ..... 260/29.2 E; 427/393.4, 427/336; 528/293, 295; 428/480, 265, 267, 290

[56] References Cited

U.S. PATENT DOCUMENTS

| | | | |
|---|---|---|---|
| 3,416,952 | 12/1968 | McIntyre et al. | 8/115.6 |
| 3,619,269 | 11/1971 | McIntyre et al. | 427/389.9 |
| 3,779,993 | 12/1973 | Kibler et al. | 260/29.2 EP |
| 3,959,230 | 5/1976 | Hays | 260/29.2 E |
| 4,013,627 | 3/1977 | Temple | 526/245 |
| 4,156,073 | 5/1979 | Login | 528/295 |
| 4,168,145 | 9/1979 | Hintermeier et al. | 528/173 X |

FOREIGN PATENT DOCUMENTS

| | | | |
|---|---|---|---|
| 1088984 | 10/1967 | United Kingdom | 427/389.9 |

*Primary Examiner*—Michael R. Lusignan
*Attorney, Agent, or Firm*—Cruzan Alexander; Donald M. Sell; Lorraine R. Sherman

[57] ABSTRACT

A process is disclosed for surface-modifying shaped essentially synthetic fiber articles so as to impart to them stain-release properties that endure through many launderings. The process subjects the article to a water-dispellable non-crystalline polymeric compound and a water-soluble salt in an aqueous swelling environment.

30 Claims, No Drawings

SYNTHETIC FIBER SURFACE-MODIFICATION PROCESS

TECHNICAL FIELD

This invention relates to an improved surface-modifying treatment of shaped articles, particularly to shaped articles comprising synthetic fibers, the treatment providing the article with a durable stain-releasing finish.

BACKGROUND ART

The treatment of synthetic fibers to impart to them stain-release properties is well known in the art. The most common synthetics used as fibers are polyethylene terephthalate, polyamides, polyacrylonitriles, and polyolefins which possess a hydrophobic character, making their laundering (particularly as regards the removal of oily soil and oily stains) difficult. This is due in large part to the inherent low wettability of these synthetic fibers. Oily soil or stain is difficult to remove in an aqueous laundering process since the oily material tends to become attached to the hydrophobic, or oleophilic, fibers. Assignee's copending patent application, Ser. No. 146,149, filed May 2, 1980, in the names of W. K. Larson, M. M. Lynn, and E. S. McAlister discloses use of sulfonated polyester polymers to surface-modify shaped essentially polyester articles to provide them with a stain-releasing finish durable to multiple launderings, and this patent application is incorporated herein by reference. By "sulfonated" or "sulfo" is meant a $-SO_3X$ group in which X is hydrogen or alkali metal cation, such as sodium, potassium, and lithium; alkaline earth metal cation; tertiary, and quaternary ammonium cations having zero to 18 carbon atoms, such as ammonium, hydrazonium, N-methyl pyridinium, guanidinium, methylammonium, butylammonium, diethylammonium, triethylammonium, tetraethylammonium, and benzyltrimethylammonium; monovalent cations are preferred.

It is known in the art to use water-soluble salts to help catalyze the cross-linking of permanent press resins for synthetic/cotton shaped articles. The use of water-soluble salts is well known in the dye industry to improve the exhaustion of certain dyestuffs. It is novel in the art, however, to use such salts in combination with soil-release agents in aqueous environments to improve soil-release properties. In general, such salts increase the durability of the treated synthetic fabric to laundering and at the same time reduce the concentration of surface-modifying agent used in the aqueous environment.

DISCLOSURE OF INVENTION

This invention provides a process for the treatment of synthetic fibers with a sulfonated polyester stain-releasing finish, which process comprises the addition of water-soluble salts to the aqueous fabric treating bath in combination with the sulfonated polyester treating agent. Optionally, conventional additives such as dyes, dye carriers, etc., may also be added. Use of a water-soluble salt applied in conjunction with a sulfonated polyester stain-release agent significantly enhances the performance of the stain-release agent over controls treated without the salt. This addition allows for reduction of as much as 50% or more in the amount of sulfonated polyester agent needed in the bath, while providing increased durability of the treated synthetic fabric to laundering. The water-soluble salts have been shown to not adversely affect the dyeing process nor cause difficulty in the application of the stain-release agent in effective concentrations.

The invention also provides shaped articles having a stain-releasing finish produced by the above mentioned process, said shaped articles with their releasing finish being durable through a series of laundering operations.

"Shaped articles" as used herein refers to filaments, fibers, films, and articles made therefrom, including fabrics. "Shaped essentially synthetic fiber article" may contain other materials besides synthetic fibers; for example, it may be a fabric blend of synthetic with cotton fibers.

Further, this invention provides an improved aqueous treating bath for rendering shaped essentially synthetic fiber articles stain-releasant, the bath comprising water-dispellable non-crystalline sulfonated polyester polymers and water-soluble salts admixed in an aqueous environment, and optionally comprising dyes and additives such as emulsifiers, dyeing assists, and adjuvants such as surfactants, water-softeners, bleaches, and brighteners.

The synthetic hydrophobic fibers, having monofilament or spun construction, suitable for treatment according to the present invention comprise:

- polyesters such as Dacron® (E. I. duPont de Nemours & Co., Inc.),
  - Fortrel® (Celanese Corp. of America),
  - Kodel® (Eastman Chemical Products, Inc.), and blends with other synthetic or natural fibers;
- polyamides such as
  - nylon 66, nylon 6, Qiana® (E. I. duPont de Nemours & Co., Inc.), and blends thereof.

It is anticipated that other synthetic fibers, such as polyacrylonitriles, polyolefins, and acetates, in combination with suitable sulfopolyester surface-modifying polymers and salt will also benefit from the treatment according to the present invention.

DETAILED DESCRIPTION OF THE INVENTION

This invention provides a process for making a shaped essentially synthetic fiber article with a surface-modification to provide said article with stain-release properties, said process comprising the steps:

(1) admixing in an aqueous swelling environment (a) a water-dispellable non-crystalline organic polyester polymer having at least 30 but no more than 70 mole percent of ethylene terephthalate units, a molecular weight of about 700 to 50,000 or more, and one equivalent weight of sulfonic acid or ionizable sulfonic acid salt group per 700 to 8000 grams, said polymeric compound being characterized in that it contains substantially equimolar amounts of the residues of (1) 100 mole percent of dicarboxylic acids consisting essentially of (a) 0 to 65 mole percent aliphatic dicarboxylic acids having at least two carbon atoms between carbonyl groups and having an average of 4 to 10 carbon atoms, (b) 30 to 90 mole percent unsulfonated aromatic dicarboxylic acids of which at least 30 but no more than 70 mole percent is terephthalic acid, and (c) 5 to 60 mole percent of aliphatic or aromatic dicarboxylic acids having 4 to 12 carbon atoms and having one sulfonic acid or sulfonic acid salt group, and (2) 100 mole percent of glycols consisting essentially of aliphatic glycols containing 2 to 10 carbon atoms and up to 4 non-peroxidic catenary oxygen atoms, of which glycols at least 30 mole percent is ethylene glycol, and (b) 0.001 to 20% of water-soluble salt with respect to fiber weight, (2) contacting said shaped essentially synthetic fiber article with said aqueous environment, (3) causing swelling of at least the surface of said shaped article, while said shaped article is in initmate contact with said water-dispellable non-crystalline polymeric compound and said water-soluble salt, and (4) isolating said shaped article from said aqueous environment.

Acid residues as used herein refer to the species remaining after removal of the active hydrogen atoms from the acid groups. Glycol residues refer to the species remaining after removal of the OH groups from the diols.

By the term "water-dispellable" non-crystalline, it is meant that the sulfonic acid or ionizable sulfonic acid salt group-containing organic polymer of use in the process of the invention is either completely soluble in water in all proportions or possesses water-dispellability in water in accordance with the test described in U.S. Pat. No. 4,052,368, column 6, lines 9–19, which test is as follows:

Water-Dispellability: Approximately 1 gram of polyester resin is put in a 125 ml jar and 99 ml of 20° C. tap water is added. A cap is placed on the jar, which is then mounted on a reciprocating shaker for 2 hours. If no pieces of resin remain, the resin is termed water-dispellable. If some pieces of the resin remain, the mixture is transferred to a 250 ml beaker and heated to about 180° F. (80° C.) for 20 minutes. If no pieces of resin then remain, the resin is deemed water-dispellable. If, however, pieces of the resin can still be discerned, the resin is considered not to be water-dispellable.

By "non-crystalline" it is meant that the organic polymer shows no crystallinity detectable by birefringence measurements.

Water-soluble salts and their hydrates useful in the practice of the present invention include monovalent cationic salts such as NaCl, KCl, $Na_2SO_4$, $NH_4Cl$, and $(CH_3)_3N(CH_2C_6H_5)Cl$; divalent cationic salts such as $MgCl_2$, $MgSO_4$, $Mg(NO_3)_2$, $Mg(C_2H_3O_2)_2$, $CaCl_2$, $BaCl_2$, $MnCl_2$, and $ZnCl_2$; and trivalent cationic salts such as $Al_2(SO_4)_3$ and $Cr(C_2H_3O_2)_3$.

The preferred water-soluble salts of the present invention are the divalent cationic salts; the most preferred salt is $MgCl_2.6H_2O$.

In the process of the present invention, the shaped article is brought into contact with the stain-releasing agent and water-soluble salt in an aqueous swelling environment for a time sufficient to cause swelling of at least the surface of the polyester article.

The nature of the surface-modification is not specifically understood but it is believed that there is involved a "wicking operation" in which the synthetic fibers swell in the aqueous environment, during which process the polymeric stain-release agent becomes locked onto and into the fibers.

Aqueous swelling environments include water baths such as the following: textile washing baths as in mill scouring procedures, common household or commercial washing machines; textile dyeing baths; baths containing synthetic fiber swelling agents (commonly called carriers in the dye industry) such as, for example, methyl naphthalene, biphenyl, chlorinated benzene, diallyl phthalate, and others; and padding operations as is done in the dyeing of textile materials. These examples are merely indicative of possible swelling environments and are not meant to limit the scope of this invention in any way.

The swelling environment may be provided as part of the dyeing or fabric manufacturing processes or it may be supplied by the consumer during the laundering process. The stain-release agents of the present invention do not have to be incorporated into or onto the fibers during the manufacturing process; they may be added to the fibers by the consumer during the laundering process.

Preferably, the shaped synthetic article is contacted with about 0.01 to 1, more preferably 0.1 to 0.5, and most preferably 0.15 to 0.25 parts by weight of stain-releasing agent per 100 parts by weight of the shaped synthetic article.

Preferably, the percent of salt with respect to fabric weight for monovalent cationic water-soluble salts is 3 to 20% and more preferably it is 5 to 15%; preferably the percent of salt for divalent cationic salts is 0.5 to 20% and more preferably it is 1.25 and 10%; preferably the percent of salt for trivalent cationic salts is 0.001 to 0.1% and more preferably it is 0.01 to 0.05%.

Generally, the contact is made in a bath of about 3 to about 35 parts, preferably about 8 to about 15 parts of water per part by weight of shaped article, the bath optionally containing a chemically effective amount of a swelling agent or carrier, preferably in a concentration of 1 to 15% by weight of synthetic shaped article. Satisfactory performance of the stain-release agent and water-soluble salt is readily achieved by applying the agent and salt during the dyeing of the article without altering dyeing conditions. Typically, contact times can be from about 5 minutes to about three hours at temperatures from about 35° C. to 150° C. or higher. Generally, the longer the contact time and the higher the contact temperature in the bath, the greater the durability of the stain-release finish of the treated shaped article. Thus, in cool water fairly long contact times are required to provide stain-release to articles that are then durable through only one or two washing cycles. The durability of stain-release increases to 30 or more washing cycles or more on increasing contact temperature to 125° to 150° C. as in a typical pressure jet dye applicator where only 10 minutes to about an hour of contact temperatures is necessary. However, longer times of contact are not detrimental.

Contact of the shaped synthetic article with the stain-release agent and water-soluble salt can be made in a padding operation. In such a process, the synthetic article is padded with a solution containing sufficient chemical to deposit 0.01 to 1, more preferably 0.1 to 0.5, and most preferably 0.15 to 0.25 parts by weight of soil-release agent per 100 parts by weight of synthetic article. The shaped article may then be subjected to steam at 90° to 150° C. for about 10 to 60 seconds. This process results in the stain-release agent becoming locked into and onto the synthetic fibers.

The process disclosed herein anticipates the use of emulsifiers, dyeing assists, and adjuvants (such as surfactants, water-softeners, bleaches, and brighteners) which are commonly used in laundering. Emulsifiers useful herein include any of the surface active agents of the anionic, nonionic, amphoteric or zwitterionic type.

The procedures utilized in obtaining the data in TABLES II through XI follow.

TREATING PROCEDURE

The shaped articles in the examples below were undyed continuous filament woven or knit synthetic fabrics (except for spun fibers in Table VIII and dyed fabrics of TABLES IX and X) which were previously washed or scoured, using 2% trisodiumpolyphosphate and 2% non-ionic surfactant (Tanapon X-70, Tanatex Chemical Corp.) based on fabric weight. The fabric (weight 10 g) was placed in a 225 ml water bath at 100° F. (38° C.) in a Multidye pressure vessel (Renigal, Sociedad Anonima, Spain), the bath having been acidified to pH 4.5 with acetic acid, 2% of methyl naphthalene carrier with respect to fabric weight (Hipochem TA-3, High Point Chemical Corp.) was added as well as other desired additives: e.g., sulfopolyester, salts, dyes, etc., then agitated using plunger action. The vessel was closed, temperature raised to 265° F. (130° C.) at 4° F./min (2° C./min), held for 30 min (with agitation). The fabric was cooled, removed from the bath, rinsed in clear water, and then heat set at 150° C. for 5 min.

The treated fabric was evaluated after it had been laundered, stained, "after-stain" laundered, and dried by a standard procedure (set out below) for 1, 5, 10, 15, 20, 25, or more laundering times. This procedure is modified AATCC Test Method 130–1977. After each of the above intervals, a sample of the fabric was spotted with 5 drops of dirty motor oil then washed 1X, and rated visually on a scale of 1–5:1=no removal, 5=complete removal.

APPARATUS

A. Washer—Top Loading Sears Kenmore Automatic Model 600.
B. Dryer—Sears Kenmore, Model 600.
C. Ballast—4 pounds of approximately 8 ounce fabric were cut into 36"×36" squares, and hemmed.

SPECIMEN

Fabric specimen or sample size was 8"×8" minimum, 12"×12" maximum.

DURABILITY LAUNDERING PROCEDURE

A. Samples and ballast were placed in the washer. Total weight was 4±0.5 pounds. Ballast weight was not less than 3 pounds.
B. 150 ml (46 grams) Tide laundry detergent, 6.1% phosphate level (Proctor and Gamble Co.) were added.
C. Washer was filled to high water level with water at 120°±5° F. (49°±3° C.).
D. Samples were washed using a 12 minute Normal wash cycle.
E. Samples were dried* at 71° C. for 45 min. in a Sears Kenmore gas dryer, Model 600.

*After laundering 1, 5, 10, 15×, etc., samples were dried.

STAINING PROCEDURE

A. Synthetic fabric was placed on a blotter.
B. 5 drops of dirty motor oil were dropped on specimen to form a single puddle in the center of specimen.
C. 3×3 inch piece of glassine paper was placed over the puddle of oil.
D. A weight was placed on the film directly over the oil and allowed to set for 60 seconds.
E. The weight and glassine paper were removed.
F. Test specimens were allowed to hang without touching each other for 15 minutes to one hour before laundering.
G. The stained specimen was laundered according to the after-stain laundering procedure below.
H. Multiple launderings were conducted using the durability laundering procedure above. The product durability was evaluated after the selected wash interval using the after-stain laundering procedure below.

AFTER-STAIN LAUNDERING PROCEDURE

A. Samples and ballast (total weight 4±0.5 lbs) were placed in the washer.
B. 320 ml (100 g) Tide laundry detergent was added.
C. Washer was filled to high water level with water at 120° F. (49°±3° C.).
D. Samples were washed using a 12 minute Normal wash cycle.
E. Test samples were rated (see below) within 4 hours after drying.

EVALUATION (Modification of AATCC Test Method 130–1977)

A. Black-top table was placed directly in front of viewing board.
B. The Stain Release Replica was mounted on the viewing board 45 inches above floor.
C. The test specimen was placed flat in the center of the black-topped table.
D. The viewing distance was 30 inches measured from the back mounting board 35 inches above the floor with the eye at 62±6 inches from the floor. An observer visually rated this stained specimen by comparing to the Replica and reported to the nearest 0.5 rating.

The sulfonated polyester polymers used to surface-modify the shaped articles in the examples below are described in TABLE I. They are prepared as described in EXAMPLE 1 of U.S. patent application Ser. No. 146,149, supra.

TABLE I

| | Sulfonated Polyester Polymers | | | |
|---|---|---|---|---|
| | Dicarboxylic Acid (Mole %)[a] | | | Glycol (Mole %)[a] |
| Compound | Terephthalic Acid | 5-Sulfo-Isophthalic Acid Sodium Salt | Adipic Acid | Ethylene Glycol |
| I | 65 | 15 | 20 | 100 |
| II | 30 | 5 | 65 | 100 |
| III | 45 | 25 | 30 | 100 |
| IV | 35 | 60 | 5 | 100 |
| V | 75 | 15 | 10 | 100 |
| VI | 75 | 10 | 15 | 100 |
| VII | 80 | 10 | 10 | 100 |

[a]Mole percent is of monomer residues in polymer

Objects and advantages of this invention are further illustrated by the following examples, but the particular materials and amounts thereof recited in these examples, as well as other conditions and details, should not be construed to unduly limit this invention.

EXAMPLE 1–12

TABLE II

| Stain-Release Efficacy-Effect of Monovalent Cationic Salts | | | | | | | | |
|---|---|---|---|---|---|---|---|---|
| Salt | | | Sulfopolyester I[b] | Rating[c] | | | | |
| Example | Formula | %[a] | % | 1L | 5L | 10L | 20L | 30L |
| 1 | Control | 0 | 0 | 1 | 1 | 1 | — | — |
| 2 | Control | 0 | 0.5 | 5 | 4.5 | 4 | 2.5 | 1.5 |
| 3 | Control | 0 | 0.2 | 3.5 | 3 | 1 | — | — |
| 4 | NaCl | 5 | 0.2 | 4.5 | 4.5 | 4 | 1.5 | — |
| 5 | NaCl | 15 | 0.2 | 5 | 5 | 4.5 | 4 | 2 |
| 6 | $Na_2SO_4 . 2O$ | 5 | 0.2 | 5 | 4 | 3.5 | 1 | — |
| 7 | $Na_2SO_4 . 2O$ | 15 | 0.2 | 5 | 4.5 | 4.5 | 3.5 | 1 |
| 8 | KCl | 5 | 0.2 | 5 | 4 | 3 | 2.5 | — |
| 9 | KCl | 15 | 0.2 | 5 | 4.5 | 4 | 3 | — |
| 10 | $NH_4Cl$ | 5 | 0.2 | 5 | 5 | 4.5 | 3 | — |
| 11 | $NH_4Cl$ | 15 | 0.2 | 5 | 5 | 4.5 | 3.5 | 2 |
| 12 | $(CH_3)_3N(CH_2C_6H_5)Cl$ | 15 | 0.2 | 5 | 4.5 | 4 | — | — |

[a]Percentages (%) in this and all following tables were weight percents of additives added to aqueous treating baths with respect to weight of fabric (fiber) present in said aqueous baths. The fabric, unless otherwise indicated, was 100% continuous filament polyethylene terephthalate woven fabric.
[b]Polymer I of TABLE I.
[c]Rated by visual inspection using modified AATCC Test Method 130-1977 (described above), after carrying out the following steps (described in detail above): (1) sulfopolyester and salt treatment of fabric; (2) launderings (L), for 1, 5, 10, etc. cycles; (3) spotting with dirty motor oil after the indicated cycles; (4) one "after-stain" laundering; and (5) rating: 5 indicated complete removal, 1 indicated essentially no removal.

TABLE II shows that with monovalent cationic salts used in the aqueous environment it was possible to achieve greater durability towards laundering than without salts while reducing by as much as 60% the amount of stain-release agent (sulfopolyester I) present.

EXAMPLE 13–28

TABLE III

| Stain-Release Efficacy-Effect of Divalent Cationic Salts | | | | | | | | | | |
|---|---|---|---|---|---|---|---|---|---|---|
| Salt | | | Sulfopolyester I | Rating | | | | | | |
| Example | Formula | % | % | 1L | 5L | 10L | 20L | 30L | 40L | 55L |
| Control | none | 0 | 0 | 1 | 1 | 1 | — | — | — | — |
| Control | none | 0 | 0.2 | 3.5 | 3 | 1 | — | — | — | — |
| 13 | $MgCl_2 . 6H_2O$ | 1.25 | 0.2 | 5 | — | — | 4.5 | 4 | 3.5 | 2.5 |
| 14 | $MgCl_2 . 6H_2O$ | 2.5 | 0.2 | 5 | 5 | 4.5 | 4 | 4 | 4 | 3 |
| 15 | $MgCl_2 . 6H_2O$ | 5 | 0.2 | 5 | 5 | 4.5 | 4 | 3.5 | 3.5 | 2.5 |
| 16 | $MgCl_2 . 6H_2O$ | 10 | 0.2 | 5 | 5 | 4.5 | 4 | 3.5 | 3.5 | 3 |
| 17 | $CaCl_2$ | 2.7 | 0.2 | 5 | 4.5 | 4 | 3.5 | 2 | — | — |
| 18 | $BaCl_2$ | 2.5 | 0.2 | 5 | 4.5 | 4.5 | 3.5 | 2.5 | — | — |
| 19 | $BaCl_2$ | 10 | 0.2 | 5 | 2.5 | 2.5 | 1.5 | 2 | — | — |
| 20 | $MgSO_4 . 7H_2O$ | 5 | 0.2 | 4.5 | 4 | 3.5 | — | — | — | — |
| 21 | $MgSO_4 . 7H_2O$ | 10 | 0.2 | 4.5 | 4.5 | 4 | 1 | — | — | — |
| 22 | $Mg(NO_3)_2 . 6H_2O$ | 6.3 | 0.2 | 5 | 4.5 | 4.5 | 3.5 | 2 | 2 | — |
| 23 | $Mg(C_2H_3O_2)_2$ | 5 | 0.2 | 1 | 1 | 1 | — | — | — | — |
| 24 | $Mg(C_2H_3O_2)_2$ | 1 | 0.2 | 5 | 5 | 4.5 | 2.5 | — | — | — |
| 25 | $Mg(C_2H_3O_2)_2$ | 0.1 | 0.2 | 3.5 | 1 | 1 | 1 | — | — | — |
| 26 | $MnCl_2 . 4H_2O$ | 5 | 0.2 | 5 | 5 | 4 | 1 | — | — | — |
| 27 | $MnCl_2 . 4H_2O$ | 10 | 0.2 | 5 | 4.5 | 4.5 | 4 | 4 | — | — |
| 28 | $ZnCl_2$ | 3.3 | 0.2 | 2 | 1 | 1 | — | — | — | — |

TABLE III indicates that by using lower levels of divalent cationic salts compared with monovalent cationic salts in the aqueous environment, it was possible to achieve much greater durability to laundering while reducing by as much as 60% the amount of stain-release agent (sulfopolyester I) used.

EXAMPLE 29–36

TABLE IV

| Stain-Release Efficacy-Effect of Trivalent Cationic Salts | | | | | | | | |
|---|---|---|---|---|---|---|---|---|
| Salt | | | Sulfopolyester I | Rating | | | | |
| Example | Formula | % | % | 1L | 5L | 10L | 20L | 30L |
| Control | none | 0 | 0 | 1 | 1 | 1 | — | — |
| Control | none | 0 | 0.2 | 3.5 | 3 | 1 | — | — |
| 29 | none | 0 | 0.2 | 4 | 2 | 1 | — | — |
| 30 | $Al_2(SO_4)_3 . 16H_2O$ | 0.1 | 0.2 | 2 | 1 | 1 | — | — |
| 31 | $Al_2(SO_4)_3 . 16H_2O$ | 0.05 | 0.2 | 3.5 | 2.5 | 2.5 | — | — |
| 32 | $Al_2(SO_4)_3 . 16H_2O$ | 0.01 | 0.2 | 4.5 | 4.5 | 4 | 1.5 | — |
| 33 | $Al_2(SO_4)_3 . 16H_2O$ | 0.001 | 0.2 | 4.5 | 1 | 1 | — | — |
| 34 | $Cr(C_2H_3O_2)_3$ | 0.01 | 0.2 | 4.5 | 3 | 1.5 | — | — |
| 35 | $Cr(C_2H_3O_2)_3$ | 0.001 | 0.2 | 4.5 | 1 | 1 | — | — |
| 36 | $Cr(C_2H_3O_2)_3$ | 5.6 | 0.2 | 1 | 1 | — | — | — |

TABLE IV indicates that by using much lower levels of trivalent cationic salts compared with monovalent or divalent cationic salts in the aqueous environment, it was possible to achieve durability towards laundering while reducing by as much as 60% the amount of stain-release agent (sulfopolyester I) present. Higher than necessary levels of trivalent cationic salts resulted in decreased performance.

EXAMPLE 37–43

TABLE V

Effect of Varying Sulfopolyester Concentration Using Magnesium Chloride as Salt Additive

| Example | $MgCl_2 . 6H_2O$ % | Sulfopolyester I % | Rating 1L | 5L | 10L | 20L | 30L |
|---|---|---|---|---|---|---|---|
| Control | 0 | 0 | 1 | 1 | 1 | — | — |
| 37 | 0 | 0.2 | 4 | 2.5 | 1.5 | — | — |
| 38 | 10 | 0.2 | 5 | 4.5 | 4.5 | 4 | 3.5 |
| 39 | 10 | 0.15 | 4.5 | 4.5 | 4 | 3.5 | 3.5 |
| 40 | 10 | 0.10 | 4.5 | 4.5 | 4 | 3 | 3 |
| 41 | 0 | 0.10 | 1 | 1 | — | — | — |
| 42 | 10 | 0.05 | 2.5 | 2 | 1.5 | — | — |
| 43 | 10 | 0.025 | 1 | 1 | — | — | — |

TABLE V shows that by using $MgCl_2.6H_2O$ in the aqueous environment, useful durability towards laundering was achieved at levels of stain-release agent as low as 0.05% with respect to fabric weight, with the optimum results achieved when the level of stain-release agent was about 0.2%.

EXAMPLE 44–57

TABLE VI

Effect of Varying Monomer Ratios in Sulfopolyesters[d]

| Example | $MgCl_2 . 6H_2O$ % | Sulfopolyester No. | % | Rating 1L | 5L | 10L | 20L |
|---|---|---|---|---|---|---|---|
| Control | 0 | 0 | 0 | 1 | 1 | 1 | — |
| 44 | 0 | I | 0.2 | 4 | 2.5 | 1 | 1 |
| 45 | 5 | I | 0.2 | 5 | 5 | 4.5 | 3.5 |
| 46 | 0 | II | 0.2 | 1 | 1 | 1 | — |
| 47 | 5 | II | 0.2 | 4.5 | 3 | 1 | 1 |
| 48 | 0 | III | 0.2 | 5 | 4 | 3.5 | 2 |
| 49 | 5 | III | 0.2 | 5 | 5 | 4.5 | 3.5 |
| 50 | 0 | IV | 0.2 | 1 | 1 | 1 | 1 |
| 51 | 5 | IV | 0.2 | 1 | 1 | 1 | 1 |
| 52 | 0 | V | 0.2 | 4.5 | 3 | 3 | 2 |
| 53 | 5 | V | 0.2 | 5 | 5 | 4.5 | 3.5 |
| 54 | 0 | VI | 0.2 | 2 | 1.5 | 1 | 1 |
| 55 | 5 | VI | 0.2 | 2.5 | 2.5 | 1 | 1 |
| 56 | 0 | VII | 0.2 | 2 | 1.5 | 1 | 1 |
| 57 | 5 | VII | 0.2 | 1 | 1 | 1 | 1 |

[d]Polymers from TABLE I

TABLE VI indicates that superior durability towards laundering was achieved with stain-release agents I, III, and V. Sulfopolyester compound VII was almost insoluble in the aqueous environment, and became completely insoluble in the presence of salt.

EXAMPLE 58–61

TABLE VII

Effect of Dyes on Stain-Release Efficiency

| Example | Salt Formula | % | Sulfopolyester I % | Dye[e] % | Rating 1L | 5L | 10L | 20L |
|---|---|---|---|---|---|---|---|---|
| Control | none | 0 | 0 | 0.5 | 1 | 1 | 1 | — |
| 58 | none | 0 | 0.2 | 0.5 | 5 | 5 | 3 | 3 |
| 59 | $MgCl_2 . 6H_2O$ | 10 | 0.2 | 0.5 | 5 | 5 | 5 | 5 |
| 60 | $MnSO_4 . 4H_2O$ | 10 | 0.2 | 0.5 | 5 | 5 | 5 | 4.5 |
| 61 | $MgSO_4 . 7H_2O$ | 10 | 0.2 | 0.5 | 5 | 5 | 5 | 4.5 |

[e]Dye mixture: Equal parts of (1) Intrasil Yellow 42 (Crompton and Knowles Corp.), (2) Eastman Polyblue 6LF (Eastman Chemical Co.), and (3) Amarcon Rubine EBC (American Chemical Co.)

TABLE VII shows that the presence of dye does not affect the improved durability towards laundering achieved when salt as well as stain-release agent is present in the aqueous environment.

EXAMPLE 62–76

TABLE VIII

Effect of Sulfopolyester With And Without Salt Treatment On Various Fabric Compositions (No Carrier)

| Example | $MgCl_2 . 6H_2O$ % | Sulfopolyester I % | Fabric[f] | Rating 1L | 5L | 10L | 20L |
|---|---|---|---|---|---|---|---|
| 62 | 0 | 0 | A | 1 | 1 | 1 | — |
| 63 | 0 | 0.2 | A | 4 | 1 | 1 | — |
| 64 | 5 | 0.2 | A | 5 | 4.5 | 4.5 | — |
| 65 | 0 | 0 | B | 1 | 1 | 1 | — |
| 66 | 0 | 0.2 | B | 2 | 1 | 1 | — |
| 67 | 5 | 0.2 | B | 2 | 1 | 1 | — |
| 68 | 0 | 0 | C | 4 | 3.5 | 3 | — |
| 69 | 0 | 0.2 | C | 4 | 3.5 | 3 | — |
| 70 | 5 | 0.2 | C | 4 | 3.5 | 3 | — |
| 71 | 0 | 0 | D | 1 | 1 | 1 | — |
| 72 | 0 | 0.2 | D | 3.5 | 2.5 | 1 | — |
| 73 | 5 | 0.2 | D | 3.5 | 3.5 | 3 | 2 |
| 74 | 0 | 0 | E | 1 | 1 | 1 | — |
| 75 | 0 | 0.2 | E | 2 | 2 | 2 | — |
| 76 | 5 | 0.2 | E | 2 | 2 | 2 | — |

[f]Fabric: A, see footnote (a), TABLE II; B, "Momie Weave" 50/50 polyester/cotton blend; C, Acrilan 16® acrylic (polyacrylonitrile, Monsanto Textiles Co.); D, Dacron® polyester (spun from staple fibers) (E.I. duPont de Nemours & Co., Inc.); E, 65/35 polyester/cotton blend.

As shown in TABLE VIII the use of stain-release agent and salt in the aqueous environment had a marked effect in increasing the durability towards laundering fabric made from continuous filament polyester fiber (A).

The coarse weave of "Momie Weave" (B) apparently physically entrapped oily stains.

Acrilan (C) had natural stain-release properties.

Spun polyester (D) apparently entrapped some oily stain.

Blends of polyester and cotton (B and E) showed some increase in durability towards laundering but the effect was less than with 100% continuous filament polyester.

EXAMPLE 77–94

TABLE IX

Stain-Release From Nylon Fabrics (Dye used was Nylosan Yellow CRM 0.1% Solution)

| Example | Fabric[g] | Salt Formula | % | Sulfopolyester I % | Dye % | Rating 1L | 5L | 10L | 15L | 20L | 25L | 30L |
|---|---|---|---|---|---|---|---|---|---|---|---|---|
| 77 | K | none | 0 | 1 | .1 | 4.5 | 2 | 2 | 1 | 1.5 | 2.5 | 2.5 |
| 78 | Q | none | 0 | 1 | .1 | 1 | 1 | 1 | — | — | — | — |
| 79 | S | none | 0 | 1 | .1 | 4.5 | 4 | 4.5 | 4.5 | 4.5 | — | — |

TABLE IX-continued

| Stain-Release From Nylon Fabrics (Dye used was Nylosan Yellow CRM 0.1% Solution) | | | | | | | | | | | | |
|---|---|---|---|---|---|---|---|---|---|---|---|---|
| | | Salt | | Sulfopolyester I | Dye | Rating | | | | | | |
| Example | Fabric[g] | Formula | % | % | % | 1L | 5L | 10L | 15L | 20L | 25L | 30L |
| 80 | K | $MgCl_2 . 6H_2O$ | 5 | .2 | .1 | 5 | 5 | 5 | 5 | 5 | 5 | 5 |
| 81 | Q | $MgCl_2 . 6H_2O$ | 5 | .2 | .1 | 2 | 1 | 1 | — | — | — | — |
| 82 | S | $MgCl_2 . 6H_2O$ | 5 | .2 | .1 | 3 | 3 | 2.5 | 1.5 | 2 | — | — |
| 83 | K | $MgCl_2 . 6H_2O$ | 10 | .5 | .1 | 5 | 5 | 5 | 5 | 5 | 5 | 5 |
| 84 | Q | $MgCl_2 . 6H_2O$ | 10 | .5 | .1 | 2.5 | 1 | 1 | — | — | — | — |
| 85 | S | $MgCl_2 . 6H_2O$ | 10 | .5 | .1 | 4 | 3.5 | 2.5 | 4 | 4 | — | — |
| 86 | K | $MgCl_2 . 6H_2O$ | 2 | .2 | .1 | 5 | 5 | 5 | 5 | 5 | 5 | 5 |
| 87 | Q | $MgCl_2 . 6H_2O$ | 2 | .2 | .1 | 1.5 | 1 | 1 | — | — | — | — |
| 88 | S | $MgCl_2 . 6H_2O$ | 2 | .2 | .1 | 3 | 3 | 3 | 3 | 3 | — | — |
| 89 | K | none | 0 | 0 | — | 1 | 1 | — | — | — | — | — |
| 90 | Q | none | 0 | 0 | — | 1 | 1 | — | — | — | — | — |
| 91 | S | none | 0 | 0 | — | 1 | 1 | — | — | — | — | — |
| 92 | K | none | 0 | 0 | .1 | 1 | 1 | — | — | — | — | — |
| 93 | Q | none | 0 | 0 | .1 | 1 | 1 | — | — | — | — | — |
| 94 | S | none | 0 | 0 | .1 | 1 | 1 | — | — | — | — | — |

[g]K is nylon 66 knit fabric; Q is Qiana; S is style 361 woven spun nylon (available from Testfabrics Inc.)

TABLE IX shows that sulfopolyester polymers impart improve stain-release properties to polyamide (nylon) fibers. These properties are enhanced by the addition of salt.

EXAMPLE 95–103

TABLE X

| Stain-Release From Polyester Fabrics Mill Data[h,i] | | | | | | | | |
|---|---|---|---|---|---|---|---|---|
| | Salt $MgCl_2 . 6H_2O$ | Sulfopolyester I | Fabric Color (100% continous filament | Rating | | | | |
| Example | % | % | knit polyester) | 1L | 5L | 10L | 20L | 30L |
| 95 | 0 | 0.5 | white | 4 | 4 | 4 | 3 | 2.5 |
| 96 | 5 | 0.2 | tan | 5 | 5 | 5 | 4 | 3.5 |
| 97 | 2.5 | 0.2 | dark brown | 5 | 5 | 4.5 | 3 | 1.5 |
| 98 | 1.25 | 0.2 | beige | 5 | 5 | 5 | 4.5 | 3.5 |
| 99 | 5 | 0.15 | red | 5 | 5 | 5 | 4 | 2.5 |
| 100 | 2.5 | 0.15 | apricot | 5 | 4.5 | 3 | 1 | — |
| 101 | 1.25 | 0.15 | dark green | 5 | 4.5 | 5 | 4 | 3 |
| 102 | 2.5 | 0.1 | royal blue | 5 | 5 | 5 | 4 | 3 |
| 103 | 1.25 | 0.1 | light green | 5 | 5 | 4.5 | 3 | 2 |

[h]Dyeing took place in aqueous environment simultaneous with stain-release (and salt) treatment
[i]Jet dyeing machine was used (Gaston County Aqualuft, Gaston County Fabrication, Stanley, N.C.)

These mill trials, as indicated in TABLE X, showed that superior results of durability towards laundering were achieved with a variety of dyed polyester fabrics when the stain-release agent and salt were present in the aqueous environment.

EXAMPLE 104–115

TABLE XI

| Effect of Salts on Effectiveness of Competitive Stain-Release Products on Polyester Woven Fabrics[l] | | | | | | | | | |
|---|---|---|---|---|---|---|---|---|---|
| | Salt | | Zelcon® 4951[j] | Milease® T[k] | Sulfopolyester I | Rating | | | |
| Example | Formula | % | % | % | % | 1L | 5L | 10L | 20L |
| 104 | None | 0 | 0.2 | 0 | 0 | 1 | 1 | — | — |
| 105 | None | 0 | 0 | 0.2 | 0 | 1 | 1 | — | — |
| 106 | None | 0 | 0 | 0 | 0.2 | 4 | 2.5 | 1 | — |
| 107 | $MgCl_2 . 6H_2O$ | 10 | 0.2 | 0 | 0 | 1 | 1 | — | — |
| 108 | $MnCl_2 . 4H_2O$ | 10 | 0.2 | 0 | 0 | 1 | 1 | — | — |
| 109 | $MgSO_4 . 7H_2O$ | 10 | 0.2 | 0 | 0 | 1 | 1 | — | — |
| 110 | $MgCl_2 . 6H_2O$ | 10 | 0 | 0.2 | 0 | 1 | 1 | — | — |
| 111 | $MnCl_2 . 4H_2O$ | 10 | 0 | 0.2 | 0 | 1 | 1 | — | — |
| 112 | $MgSO_4 . 7H_2O$ | 10 | 0 | 0.2 | 0 | 1 | 1 | — | — |
| 113 | $MgCl_2 . 6H_2O$ | 10 | 0 | 0 | 0.2 | 5 | 5 | 4.5 | 4 |
| 114 | $MnCl_2 . 4H_2O$ | 10 | 0 | 0 | 0.2 | 5 | 5 | 4.5 | 4.5 |
| 115 | $MgSO_4 . 7H_2O$ | 10 | 0 | 0 | 0.2 | 4.5 | 4.5 | 4 | 1 |

[j]E. I. dupont de Nemours & Co., Inc. (% based on solids in the product)
[k]Imperial Chemical Industries (% based on solids in the product)
[l]See footnote (a), TABLE II TABLE XI shows that the addition of salt is uniquely beneficial for sulfo-group containing stain-release agents towards laundering durability of polyester fabrics compared to nonsulfo-group containing stain-release agents thereon.

Other trials showed that the salt and stain-release agent treatment functioned equally as well at atmospheric pressure as when run in a pressure vessel. The dyeing operation is best accomplished in a pressure vessel and all examples above were run at increased pressure.

Various modifications and alterations of this invention will become apparent to those skilled in the art without departing from the scope and spirit of this invention, and it should be understood that this invention is not to be unduly limited to the illustrative embodiment set forth herein.

What is claimed is:

1. A process for providing a shaped essentially synthetic fiber article with a surface-modification to provide said article with stain-release properties, said process comprising the steps:

(1) admixing in an aqueous swelling environment of at least 35° C.

(a) a water-dispellable non-crystalline organic polyester polymer having at least 30 but no more than 70 mole percent of ethylene terephthalate units, a molecular weight of about 700 to 50,000 or more, and one equivalent weight of sulfonic acid or ionizable sulfonic acid salt group per 700 to 800 grams, said polymeric compound being characterized in that it contains substantially equimolar amounts of the residues of (1) 100 mole percent of dicarboxylic acids consisting essentially of (a) 0 to 65 mole percent aliphatic dicarboxylic acids having at least two carbon atoms between carbonyl groups and having an average of 4 to 10 carbon atoms, (b) 30 to 90 mole percent unsulfonated aromatic dicarboxylic acids of which at least 30 but no more than 70 mole percent is terephthalic acid, and (c) 5 to 60 mole percent of aliphatic or aromatic dicarboxylic acids having 4 to 12 carbon atoms and having one sulfonic acid or sulfonic acid salt group, and (2) 100 mole percent of glycols consisting essentially of aliphatic glycols containing 2 to 10 carbon atoms and up to 4 non-peroxidic catenary oxygen atoms, of which glycols at least 30 mole percent is ethylene glycol, and (b) 0.001 to 20% of a water-soluble salt with respect to fiber weight, (2) contacting said shaped essentially synthetic fiber article with said aqueous environment, (3) causing swelling of at least the surface of said shaped article, while said shaped article is in intimate contact with said water-dispellable non-crystalline polymeric compound and said water-soluble salt, and (4) isolating said shaped article from said aqueous environment with said polymer locked in and on said synthetic fiber article and remaining there after five washing cycles in an aqueous detergent bath.

2. The process according to claim 1 wherein said shaped essentially synthetic fiber article comprises polyester fiber.

3. The process according to claim 1 wherein said shaped essentially fiber article comprises polyamide fiber.

4. The process according to claim 1 wherein the water-soluble salt is a monovalent cationic salt.

5. The process according to claim 1 wherein the water-soluble salt is a divalent cationic salt.

6. The process according to claim 1 wherein the water-soluble salt is a trivalent cationic salt.

7. The process according to claim 4 wherein the monovalent cationic salt is selected from the group consisting of NaCl, KCl, $Na_2SO_4$, $NH_4Cl$, and $(CH_3)_3N(CH_2C_6H_5)Cl$.

8. The process according to claim 4 wherein the quantity of monovalent cationic salt present is in the range of 3 to 20% with respect to fabric weight.

9. The process according to claim 4 wherein the quantity of monovalent cationic salt present is in the range of 5 to 15% with respect to fabric weight.

10. The process according to claim 5 wherein the divalent cationic salt is selected from the group consisting of $MgCl_2$, $MgSO_4$, $Mg(NO_3)_2$, $Mg(C_2H_3O_2)_2$, $CaCl_2$, $BaCl_2$, $MnCl_2$, and $ZnCl_2$.

11. The process according to claim 5 wherein the divalent salt is $MgCl_2.6H_2O$.

12. The process according to claim 5 wherein the quantity of divalent cationic salt present is in the range of 0.5 to 20% with respect to fabric weight.

13. The process according to claim 5 wherein the quantity of divalent cationic salt present is in the range of 1.25 to 10% with respect to fabric weight.

14. The process according to claim 6 wherein the trivalent cationic salt is $Al_2(SO_4)_3$ or $Cr(C_2H_3O_2)_3$.

15. The process according to claim 6 wherein the quantity of trivalent cationic salt present is in the range of 0.001 to 0.1% with respect to fabric weight.

16. The process according to claim 6 wherein the quantity of trivalent cationic salt present is in the range of 0.01 to 0.05% with respect to fabric weight.

17. The process according to claim 1 wherein the water-dispellable non-crystalline organic polyester polymer is present in the range of 0.01 to 1 part per weight polymer per 100 parts by weight of shaped synthetic article.

18. The process according to claim 1 wherein the water-dispellable non-crystalline organic polyester polymer is present in the range of 0.1 to 0.5 parts per weight polymer per 100 parts by weight of shaped synthetic article.

19. The process according to claim 1 wherein the water-dispellable non-crystalline organic polyester polymer is present in the range of 0.15 to 0.25 parts per weight polymer per 100 parts by weight of shaped synthetic article.

20. A process according to claim 1 wherein said aqueous swelling environment further comprises a chemically effective amount of a synthetic fiber swelling agent.

21. A process according to claim 1 wherein the temperature of said aqueous swelling environment is up to about 150° C.

22. A process according to claim 1 wherein said aqueous swelling environment is a textile washing bath.

23. A process according to claim 1 wherein said aqueous swelling environment is a dyeing bath.

24. A process according to claim 1 wherein said aqueous swelling environment is a padding operation.

25. A process according to claim 1 wherein the contact time between the shaped article and the polymeric compound in the aqueous swelling environment is from about 10 seconds to many hours.

26. A process according to claim 1 wherein said aqueous swelling environment further includes dyeing assists, adjuvants, and surfactants.

27. An aqueous swelling bath at a temperature of at least 35° C. for providing shaped essentially synthetic fiber articles with a stain-releasing polymer finish, said polymer remaining in and on said synthetic fiber article after five washing cycles in an aqueous detergent bath, comprising a. a water-dispellable non-crystalline organic polyester polymer having at least 30 but no more than 70 mole percent of ethylene terephthalate units, a molecular weight of about 700 to 50,000 or more, and one equivalent weight of sulfonic acid or ionizable sulfonic acid salt group per 700 to 8000 grams, said polymeric compound being characterized in that it contains substantially equimolar amounts of the residues of (1) 100 mole percent of dicarboxylic acids consisting essentially of (a) 0 to 65 mole percent aliphatic dicarboxylic acids having at least two carbon atoms between carbonyl groups and having an average of 4 to 10 carbon atoms, (b) 30 to 90 mole percent unsulfonated aromatic dicarboxylic acids of which at least 30 but no more than 70 mole percent is terephthalic acid, and (c) 5 to 60 mole percent of aliphatic or aromatic dicarboxylic acids having 4 to 12 carbon atoms and having one sulfonic acid or sulfonic acid salt group, and (2) 100 mole percent of glycols consisting essentially of aliphatic glycols containing 2 to 10 carbon atoms and up to 4 non-peroxidic catenary oxygen atoms, of which glycols at least 30 mole percent is ethylene glycol, b. 0.001 to 20% of a water-soluble salt with respect to fiber weight, and c. optionally, dyes and additives such as emulsifiers, dyeing assists, carriers, adjuvants, and surfactants.

28. The shaped essentially synthetic fiber article treated by the process according to claim 1.

29. The shaped essentially synthetic fiber article according to claim 28 wherein said article comprises polyester fiber.

30. The shaped essentially synthetic fiber article according to claim 28 wherein said article comprises polyamide fiber.

* * * * *

UNITED STATES PATENT AND TRADEMARK OFFICE

CERTIFICATE OF CORRECTION

PATENT NO. : 4,329,391

DATED : May 11, 1982

INVENTOR(S) : Eugene S. McAlister

It is certified that error appears in the above—identified patent and that said Letters Patent is hereby corrected as shown below:

Col. 7, TABLE II, the formula for Examples 6 and 7 should read $Na_2SO_4 \cdot 10H_2O$ not $Na_2SO_4 \cdot 2O$.

Signed and Sealed this

*Thirty-first* Day of *August 1982*

[SEAL]

*Attest:*

GERALD J. MOSSINGHOFF

*Attesting Officer*

*Commissioner of Patents and Trademarks*